US005500088A

United States Patent [19]

Allison et al.

[11] Patent Number: 5,500,088

[45] Date of Patent: Mar. 19, 1996

[54] AUTOMATIC REFINER LOAD CONTROL

[75] Inventors: Bruce J. Allison, Vancouver; Joe E. Ciarniello, Coquitlam; Guy A. Dumont, Vancouver; Patrick J. Tessier, North Vancouver, all of Canada

[73] Assignees: MacMillan Bloedel Limited; The University of British Columbia, both of Vancouver, Canada

[21] Appl. No.: 405,613

[22] Filed: Mar. 14, 1995

Related U.S. Application Data

[63] Continuation of Ser. No. 111,526, Aug. 25, 1993, abandoned.

[51] Int. Cl.[6] ..... B02C 25/00; B02C 7/14

[52] U.S. Cl. ..... 162/198; 162/254; 162/261; 241/30; 241/36; 364/157; 364/176

[58] Field of Search ..... 162/261, 252, 162/254, 198; 241/30, 33, 36, 37; 364/157, 176, 471

[56] References Cited

U.S. PATENT DOCUMENTS

| | | | |
|---|---|---|---|
| 4,073,442 | 2/1978 | Virving | 241/37 |
| 4,233,600 | 11/1980 | Rogers et al. | 241/37 |
| 4,586,146 | 4/1986 | Dumbeck et al. | 364/551 |
| 4,646,226 | 2/1987 | Moon | 364/176 |
| 4,820,980 | 4/1989 | Dodson-Edgars | 324/207 |

OTHER PUBLICATIONS

"Self–Tuning Control of a Chip Refiner Motor Load", Dumont, G. A., Automatica, vol. 18, No. 3, pp. 307–314 (1982).

"Computer Control of a TMP Plant", Dumont, G. A., Legault, N. D., Jack, J. S., Rogers, J. H., Pulp & Paper Canada, 83:8, pp. T224–T229 (1982).

"Thermo–Mechanical Pulping Process Control", Jones, R. E., Pila, A., Canadian Pulp & Paper Association Annual Meeting, pp. B105–B111 (1983).

*Primary Examiner*—Karen M. Hastings

*Attorney, Agent, or Firm*—C. A. Rowley

[57] ABSTRACT

The load on a refiner motor is controlled by adjusting the motor load setpoint by monitoring load applied by the refiner and the plate gap between the refiner plates to define the curve of the load versus plate gap relationship. This slope of load versus plate gap relationship is estimated and when the sign of the slope of the curve changes sign indicating operation in an unstable zone of pad collapse and based on the tendency for the refiner to be in the unstable operation zone over a selected period of time exceeding a preset limit adjusting the setpoint lower to approach more closely the maximum load applied over the selected time.

4 Claims, 4 Drawing Sheets

AUTOMATIC REFINER LOAD CONTROL

This is a continuation of Ser. No. 111,526 filed Aug. 25, 1993, and now abandoned.

FIELD OF THE INVENTION

The present invention relates to a method of controlling a wood chip or pulp refiner. More particularly the present invention relates to an improved system for adjusting the setpoint for the refiner motor load in accordance with acceptable operating conditions within the refiner.

BACKGROUND OF THE PRESENT INVENTION

As is well known, wood material to be refined is introduced into the eye of a refiner and moved through a refining zone between the refiner plates. This material is progressively broken down into smaller pieces and finally into individual fibers and fiber fragments in the gap between the relatively rotating refiner plates.

In operating a refiner, water is supplied with the wood material to provide a relatively accurate control of consistency within the refiner as the consistency has a significant bearing on refiner operation and thus on pulp properties.

The other major operating variables in a refining process are the rate of infeed of the wood material which is controlled by the speed of the infeed conveyor; and the energy applied, usually specified as specific energy and defined as the net power applied which is the difference between the total power and the backed off power (no load condition) divided by the pulp mass flow through the refiner. The applied power is maintained by changing the closing pressure which changes the gap between the refiner plates.

It will be apparent that if the gap between the refiner plates reduces to zero, the refiner plates will clash resulting in metal to metal contact and at least excessive wear of the plates.

It will also be apparent that over time the refiner plates which are formed with various patterns of lands and grooves wear and as a result, the operation of the refiner changes over time.

In operation, the operator usually sets the motor load setpoint (i.e. load to be applied by the refiner discs to the pulp pad) based on the required pulp properties and production rate for a selected consistency within the refiner. If this setpoint is too high, the operation of the refiner may be impaired as the tendency for pad collapse will frequently occur and the risk of plate clashing is significant.

As above indicated, plate clashing is avoided if possible and thus safety measures have been built into the control system of the refiner to cause the plates to separate when pad collapse appears to be eminent.

Thus, a good system of determining impending pad collapse is of significant value.

In practice, the relative position or spacing between the cooperating plates forming the refining zone is monitored and when the plates become too close, they are immediately backed off to avoid impending disaster. The more common system to accomplish this monitors vibrations of the equipment and if a preset threshold is exceeded, the plate gap is increased (opened) in large step wise increments and in some cases, the refiner shuts down. Shut down of the refiner is a relatively costly remedy.

Adaptive control systems have been proposed and implemented to control the power application to a refiner based on the relationship between the plate gap and motor load whereby the plates are moved apart when the sign of the slope of the curve of power versus plate gap changes. Such a system was first proposed by Guy Dumont in Automatica, Vol. 18, No. 3, pp 307–314, 1982, in a paper entitled "Self-tuning Control of a Chip Refiner Motor Load" and further discussed in a paper entitled "Control of a TMP Plant", G. Dumont et al., Pulp and Paper Canada 83:8 (1982), pp T224–T229.

In "Thermo Mechanical Pulping Process Control" by Jones and Pila presented at the Canadian Pulp and Paper Association Annual Meeting 1983, pp B105–B111 of the preprints, a hierarchical approach to the control of thermo mechanical pulping is discussed wherein the control of specific energy is described as one of the modular subsystems of the overall control. This paper describes a system similar to that of Dumont et al. referred to above in that they propose the use of an estimate of the process gain (slope of the curve of plate gap versus power or motor load) and its sign based on the ratio of moving averages of incremental change in motor load to incremental change in plate gap. This moving average is then used to override the specific energy control and force the plates to separate if the sign of the process gain changes (i.e. moves from the stable to the unstable region) over the average selected number of samples.

A paper presented at the Mini and Micro Computer Conference in Saint Fielu, Spain, in June 1985 entitled "A Microprocessor-Based Control System for a TMP Refiner" by Koivo et al., describes an adaptive control system similar to that of Dumont described above, although very little information is given.

An article entitled "Wood Chip Refiner Control" by Dumont and Åström, IEEE Control Systems Magazine, April 1988, pp 38–43 inclusive, suggests another way of improving reliability of the adaptive controller first described by Dumont in his paper entitled "Self-Tuning Control of a Chip Refiner Motor Load". The improved system provided a substantial improvement over the previous method in that it allowed for smoother transition between the controlling and retracting modes. This system suggests actively probing the refiner to improve the accuracy of the gain estimate, and incorporates an indication of the accuracy of the gain estimate to improve the reliability of the method. This system has never been implemented on a refiner.

The paper entitled "Adaptive Control Using a Dahlin Controller with Application to Wood Chip Refining" by Banerjee et al. describes the adaptive control system similar to that of Dumont described above. This system has never been implemented on a refiner.

Kooi et al. in a paper entitled "Control of Wood Chip Refiner Using Neural Networks" published in a TAPPI Journal of June 1992, pp 156–162 inclusive describes a neural network-based controller as an alternative means to overcome some of the shortcomings of the adaptive controls schemes for chip refiners and is based on the fact that the neural network does not require exact mathematical description of the process it is controlling. This system has never been implemented on a refiner.

All of the methods just discussed are based on characterizing the motor load plate gap relationship with a linear model. This has some limitations. First, a linear model is monotonic and, therefore, cannot characterize the motor load peak. By extrapolation, the controller "thinks" that there is no limit to the maximum achievable load. Secondly, because a motor load which is less than the peak load can be achieved with two values of the plate gap, one of which ultimately leads to a pad collapse, the controller must be modified to keep it from attempting to regulate the load in the pad collapse region. Dumont and Fu in a paper entitled "Nonlinear Adaptive Control via Laguerre Expansion of Volterra Kernels", presented at the 2nd Workshop on Adaptive Control: Applications to Nonlinear Systems and Robotics, Cancùn, Mexico, December 1992, proposed an approach based on a nonlinear model. An advantage of this is that the motor load peak and the input multiplicity are easily dealt with. That is, when the setpoint is less than the maximum, there are two possible inputs. The one corresponding to the larger plate gap is implemented. When the setpoint is greater than the maximum, there is only one possible input. This corresponds to the peak load. This method requires more development before it can be applied to an industrial refiner.

Brief Description of the Present Invention

It is the object of the present invention to provide an improved method of controlling a chip or pulp refiner motor load and, in particular, for automatically adjusting the motor load setpoint.

Broadly, the present invention relates to a method and apparatus for controlling the motor load and adjusting a motor load setpoint on a refiner having a pair of opposed plates defining a plate gap there between comprising monitoring said motor load, monitoring the width of said plate gap, estimating the slope ($\hat{m}$) of a curve of motor load versus plate gap, determining when said estimated slope of said curve changes sign indicating that the motor load has traversed a peak into an unstable operating zone for the reference, continuously determining the totals $T_y$ of discrete values $T_t$ obtained over selected time periods (y), comparing the total ($T_y$) with a preselected threshold value (H), and if $T_y$ crosses said selected threshold value (H) adjusting said motor load setpoint to a new lower value.

Preferably, the maximum motor load over said time period y will be sensed.

Preferably, the total $T_y$ is determined by adding the values $T_t$ having a sign indicating operation in said unstable zone.

Preferably the values of $T_y$ will be based on $$T_y = \sum_{i=0}^{y-1} T_{t-i} \tag{1}$$

where $T_t$=one of a) the sign of $\hat{m}_t$ where $\hat{m}_t$ is negative, or b) the value of $\hat{m}_t$ where $\hat{m}_t$ is negative, or c)

$$T_t = \frac{\hat{m}_t}{\sigma_t} \tag{2}$$

where $\hat{m}_t$ is negative $\sigma_t$=standard deviation of $\hat{m}_t$ y=a selected number.

Preferably, the values $T_t$ will be determined based on $$T_t = \frac{\hat{m}_t}{\sigma_t} \tag{2}$$

where $\hat{m}_t$=negative $\sigma_t$=standard deviation of $\hat{m}_t$

Preferably, said new lower value will be the maximum motor load $L_{(max)}$ monitored over said time period y when $T_y$ crosses the threshold value H.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
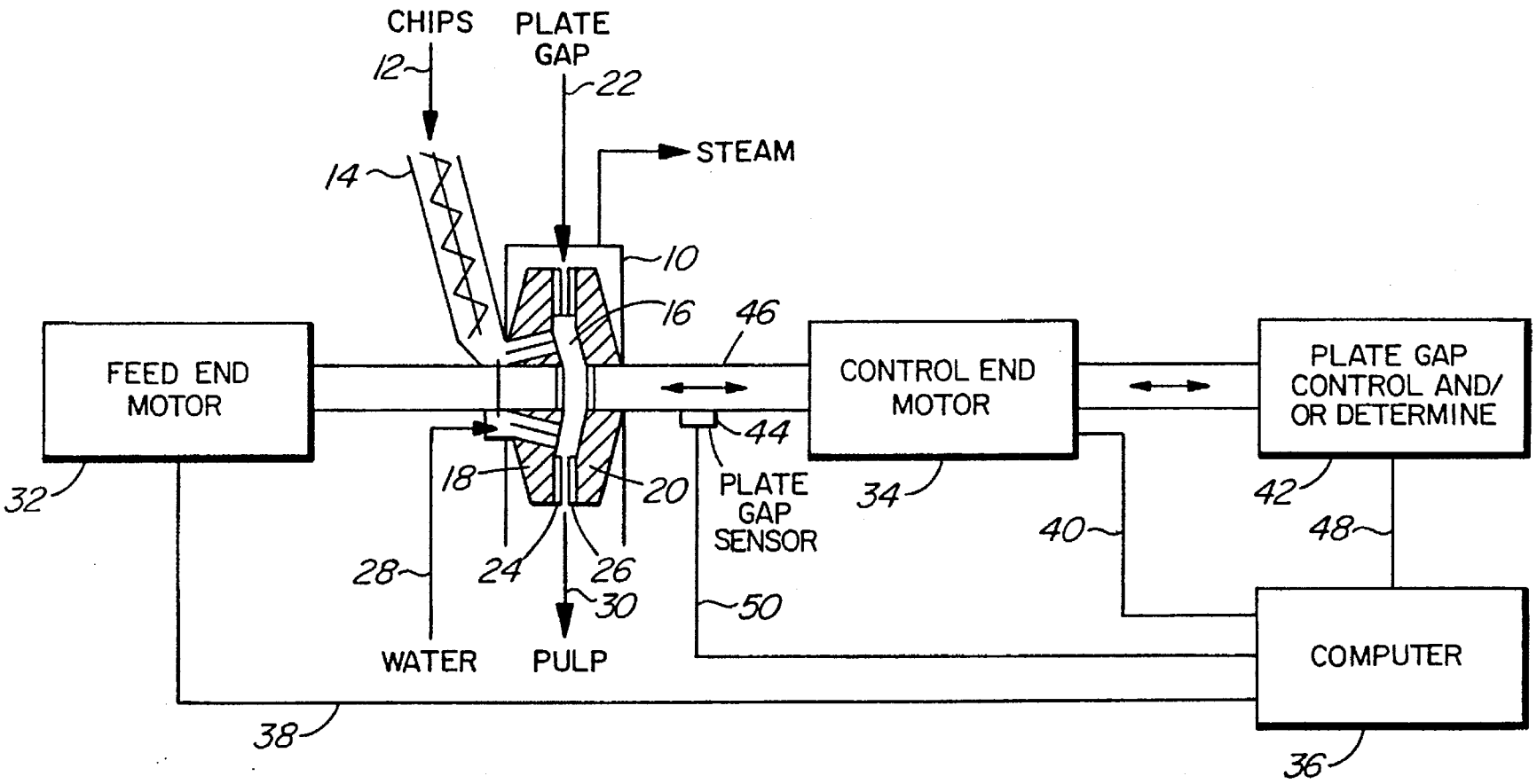
FIG. 1 is a schematic illustration of a double disc refiner showing a typical example of a refiner which may be controlled using present invention.

FIG. 1 shows a typical double disc refiner having a drive for the feed-end disc and a separate drive for the control end disc (the invention is obviously also applicable to a single disc refiner and/or twin disc refiners). In the double disc refiner as illustrated the two discs are rotated in opposite directions to maximize relative speed. It is believed the present invention should be useful with any suitable refiner including cone type refiners.

Chips introduced to the refiner 10 as indicated at 12 via the screw conveyor or the like 14 pass into the gap 16 between the counter rotating refiner discs 18 and 20. The plate gap 22 is the gap between the refiner plates 24 and 26 which are mounted in face to face relationship on the disc 18 and 20 respectively.

Water to adjust the consistency of the pulp within the refiner 10 is introduced as indicated at 28 and the pulp produced leaves the refiner as indicated at 30.

The power is delivered to the discs 18 and 20 by the motors 32 and 34 respectively, the actual total power consumed is normally continuously measured and this information sent to the computer 36 via lines 38 and 40.

The position of the disc 20 relative to the disc 18 (the plate gap)is determined via the plate gap control 42 (which may also provide a measure of the plate gap 22). The control 42 normally is formed by a double acting hydraulic cylinder, suitable control valves and a pressure source. In most cases, it is preferred to provide a separate plate gap sensor such as the sensor 44 which senses the actual position of the drive shaft 46 for the disc 20 and thereby defines to a reasonable degree the size of the plate gap 22 (obviously disc deflection, etc. has to be considered in determining the precise plate gap 22). Other gap sensors such as proximity sensors mounted on the discs may also be used.

In any event, the signals to and or from the plate gap control 42 and the computer 36 are carried via the line 48 and the information from the plate gap sensor 44 is carried to the computer 36 by the line 50.

The above describes an installation as proposed by the prior art and wherein a control computer is used to control the motor load to plate gap relationship and apply a selected load to the pulp.

It will be apparent that the load applied to the pulp, i.e. the work done on the pulp per unit quantity of pulp (specific energy) is a significant factor in determining the degree of refining to which the pulp or chips are subjected and thereby determines the properties of the pulp leaving the refiner via line 30.

The change in dilution water flow changes the consistency of the pulp within the refiner and since the consistency changes the load that may be applied per unit of pulp, it is important that this consistency be properly controlled. Generally, this is done by metering the rate of in-feed of chips (knowing the moisture content of the chips) and adjusting the consistency by applying the requisite amount of water via line 28.

In operation, a pulp pad is formed between the two discs 18 and 20 and this pulp pad resists the action of the plate gap controller 42 forcing the two discs 18 and 20 together.

Figure 3:
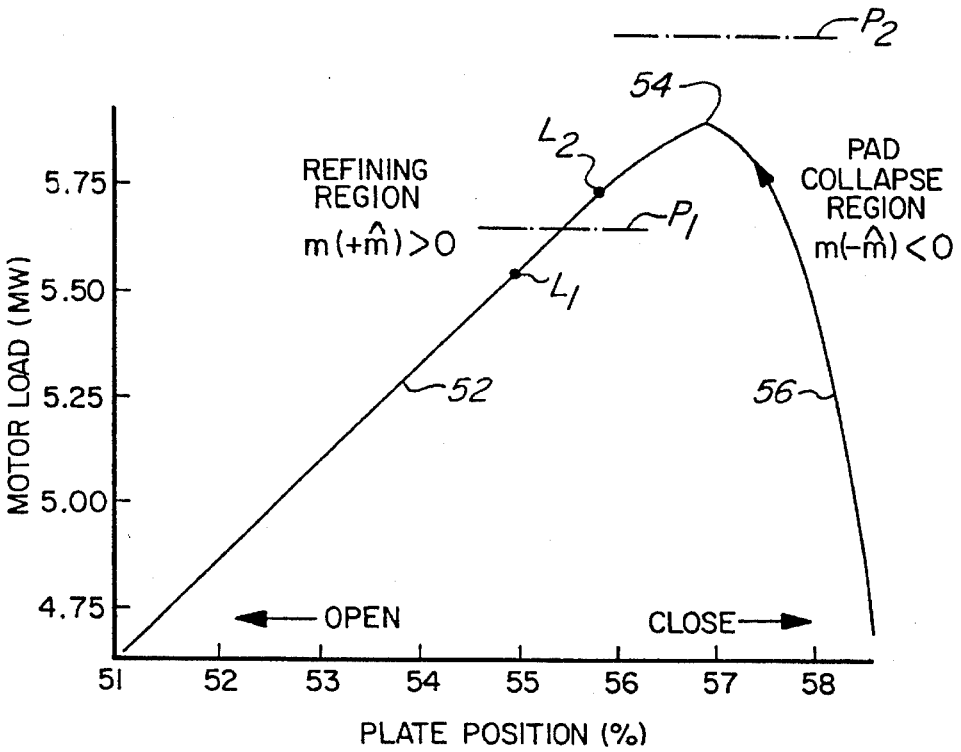
FIG. 3 is a typical curve of a motor load versus refiner plate position.

FIG. 3 shows a typical curve of motor load versus plate position wherein the closed plate position, i.e. the plates 18 and 20 approaching each other is to the right in the figure so the slope of the curve in the stable operating region 52 is positive and the unstable region or zone is negative. This curve is a typical curve as would be produced by monitoring motor load and plate gap and plotting the curve of their relationship. The plate gap 22 may be defined by the position of the shaft 46 (plate gap sensor 44). It is also known to monitor the pressure applied by the plate gap control 42 and use this pressure in effect as a measure of plate gap since the change in pressure applied by the control 42 and the change in plate gap 22 are closely related for a given refiner operation.

As can be seen in FIG. 3, as the plates are moved to the closed position, the motor load increases along the curve 52 (stable region) until it reaches a peak 54, after which the pulp pad tends to collapse, i.e. the plates are too close together and the load decreases as the plates are brought closer together as indicated by the section of the curve 56 (unstable zone or region).

On the section of the curve 52 which defines the stable region, the slope is positive, i.e. in the area where an increase in load corresponds with the closing of the gap between the plates 18 and 20 the slope is positive (to the left of peak 54) (i.e. estimated slope=$\hat{m}>0$) whereas in the region where pad collapse is occurring, i.e. along the curve portion 56 (to the right of peak 54) load is dropping as the plates are closing, the slope is negative (i.e. estimated slope=$\hat{m}<0$). Obviously, if the axes were changed so closing was to the left the signs of the portions 52 and 56 of the curve would be reversed. The actual slope m of the curve is a function of plate gap and time and thus in control schemes proposed to date, the practice is to estimate the slope $\hat{m}$ and its degree of uncertainty ($\sigma$) (standard deviation).

Such systems are described as above indicated, the papers of Dumont, Automatica Vol. 18, No. 3, pp 307–314, 1982 and in Pulp and Paper Canada 83:8 (1982), and further in IEEE Control Systems Magazine, April 1988, and thus will not be described further herein.

Figure 4:
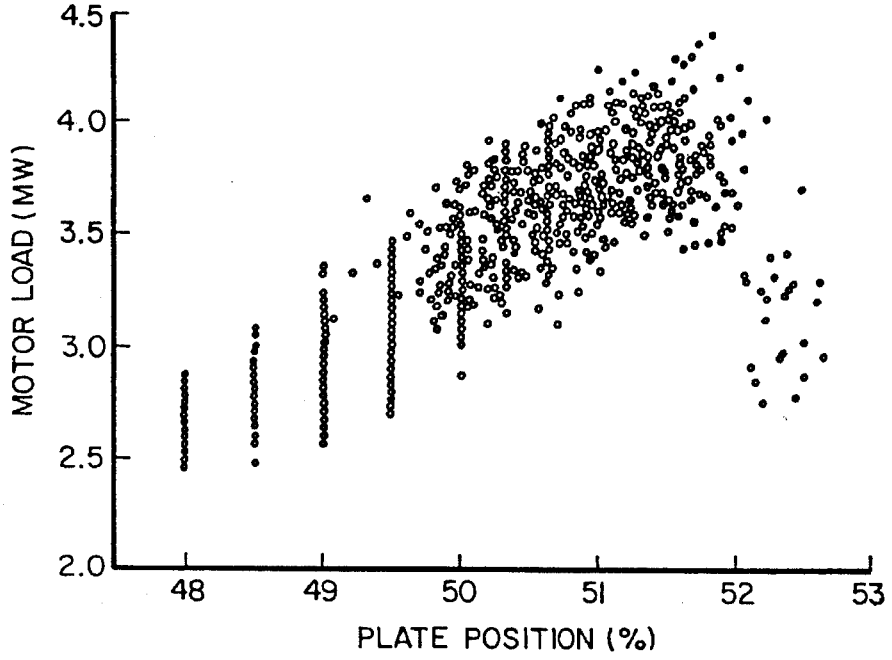
FIG. 4 is a plot similar to FIG. 3, but of actual data from monitoring a refiner.

FIG. 4 shows actual data from monitoring motor load and plate gap. As will be apparent, while FIG. 3 is a schematic representation of the curve under deterministic conditions, in practice, the conditions are stochastic and the system must accommodate the fluctuations in the process and thus, the varying positions of the curve.

Figure 2:
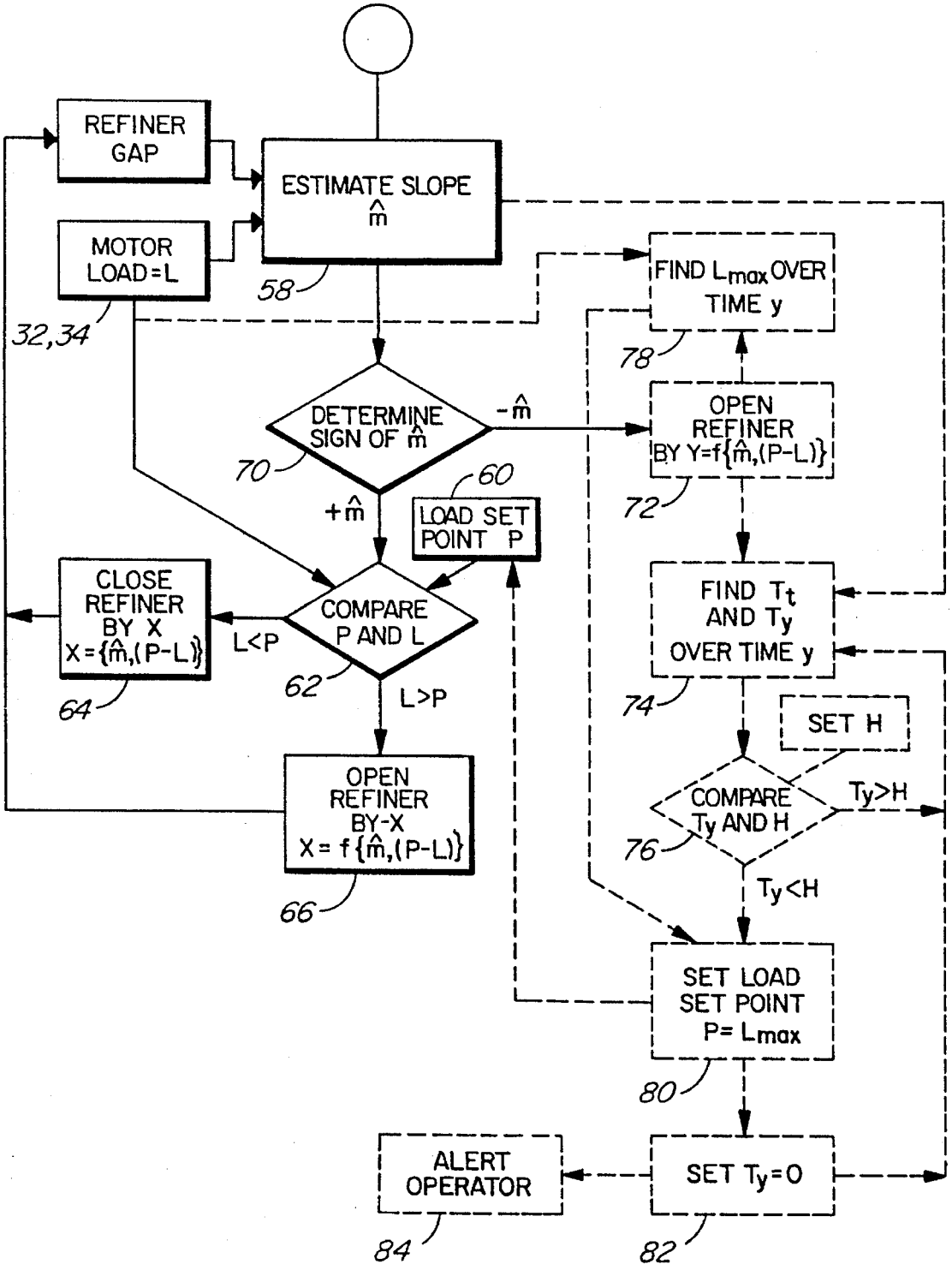
FIG. 2 is a flow diagram of a control system incorporating the present invention.

Referring to FIG. 2, the control system of prior art has been shown in solid lines and the added portions contributed by the present invention has been shown in dash line.

As illustrated, the estimate of slope $\hat{m}$ and its standard deviation $\sigma$ are determined as indicated at 58 by a recursive method as taught by the prior art.

To operate the system, a load setpoint P is defined as indicated at 60 based on pulp properties, desired production rate, etc. and the motor load L is adjusted by adjusting plate gap 22 to move along the curve 52 until the load setpoint P is reached.

If the load setpoint P is at the position $P_1$ shown in FIG. 3, i.e. on the positive sloping part of the curve 52 then the conventional prior art technique (as used with the present invention) would operate as follows; assuming the load L is at load point $L_1$, as schematically indicated in FIG. 2 the estimated slope $\hat{m}$ and degree of uncertainty in $\hat{m}$ (i.e. standard deviation $\sigma$) for the curve are defined as indicated at 58. The actual load L is compared with the setpoint load $P_1$ as indicated at 62. If the load L is less than $P_1$ as indicated by the load point $L_1$ in FIG. 3, the refiner plates are closed (more pressure is applied by the controller 42) by an amount x, i.e. the plate gap 22 is narrowed and the discs 18 and 20 move closer together by an increment or increments x. The amount of movement, i.e. the distance x is preferably determined as a function of $\hat{m}$ and the difference between the actual load L, in this example $L_1$, and the setpoint load $P_1$, i.e, $$x=f\{\hat{m},\ (P_1-L_1)\} \tag{4}$$

On the other hand, if when comparing L and $P_1$, $L>P_1$, i.e. the load is say at point $L_2$ as indicated in FIG. 3, then the refiner is opened (pressure applied by controller 42 reduced) as indicated at 64 by an amount x (a negative amount) which amount again will be a function of $\hat{m}$ and $(P_1-L_2)$ as indicated at 66.

The sign of the estimated slope $\hat{m}$ is determined as indicated at 70. If the slope is found to be positive, then the program would proceed as above described to compare P–L as indicated at 62. However, if the slope $\hat{m}$ is negative, i.e. on the portion of the curve indicated at 56 indicating operation in the unstable region, then the above described action is reversed and the refiner is opened by an increment x each time the estimated slope $\hat{m}$ is negative.

With the present invention a summing device 74 adds all negative values of $T_t$ over the past historical period of length y.

$$T_y=\sum_{i=0}^{y-1} T_{t-i} \tag{1}$$

where t=present control interval $T_t$=one of a) the sign of $\hat{m}_t$ where $\hat{m}_t$ is negative, or b) the value of $\hat{m}_t$ where $\hat{m}_t$ is negative, or c) preferably, $$T_t=\frac{\hat{m}_t}{\sigma_t} \tag{2}$$

where $\hat{m}_t$ is negative $\sigma_t$=standard deviation of $\hat{m}_t$ y=a selected number, preferably 60

In an actual operation of the present invention, the preferred system $T_t$=c) above was used and time y was set at 60 seconds and $\hat{m}_t$ and $\sigma_t$ were determined every second. Thus, the system operated on a 60 element array (i.e. y=60) and each of the negative values of $T_t$ over the 60 element array are added to obtain $T_y$.

Each second, i.e. for each successive control interval, total $T_y$ is compared with a preset threshold value H as indicated at 76. If $T_y$ crosses the threshold value H, the present invention is activated, however, if $T_y$ does not cross the threshold value H, i.e. if $T_y$ remains greater than H, i.e. the negative value $T_y$ is less negative than the negative threshold value H, the system simply continues to operate.

If $\hat{m}_t$ is negative, $T_t$ is negative ($T_y$ becomes a larger negative number) and if $\hat{m}_t$ is positive, then $T_t$ is equated to zero.

Obviously, if there are no negative values of $T_t$ in an array, $T_y$=0.

As above indicated, $T_y$ may simply be the number of times $\hat{m}_t$ is negative or the summation of the values of $\hat{m}_t$ when $\hat{m}_t$ is negative over the array, however, these systems are not as effective as the preferred system.

At the same time as $T_y$ is calculated, i.e. every control interval, the maximum load $L_{max}$ over the historical period y is determined as indicated at 78 so that if $T_y$ is less than H, the maximum load $L_{(max)}$ would provide a good indication of the peak 54 in FIG. 3. The load setpoint P is then preferably set to $L_{max}$ or less (preferably not more than 10% less than $L_{(max)}$ and most preferably not more than 5% less than $L_{(max)}$) as indicated at 80 and $T_y$ reset to zero as indicated at 82 and the process repeated.

To illustrate, if the load setpoint value were set at the level $P_2$ in FIG. 3, it is apparent that pad collapse occurs before the load $P_2$ can be reached, thus the operation point moves into the unstable region designated by section 56 indicating pad collapse is approaching. As soon as the operation is on a portion of the curve where the slope is negative, i.e. $\hat{m}$ is negative, control action is simply reversed and the refiner plates are jogged open as indicated in 72 by an increment Z which could be set as specific increment or preferably be made a function of $P_2$–L, and $\hat{m}$, e.g. be calculated as was x above, i.e.

$$Z=f\{\hat{m},\ (P_2-L)\} \tag{5}$$

To determine $L_{max}$ (the maximum load over the time y of the array), the instantaneous load readings preferably are made at the same time $T_t$ and $T_y$ are determined for each array, i.e. each interval produces a load signal $L_t$. The historical load readings would be $L_t$, $L_{t-1}$, $L_{t-2}$, . . . $L_{t-y}$, where y=60.

It will be apparent that the actual load signal fluctuates up and down significantly and thus it is necessary to filter the load signals and provide filtered load signal $L^f_t$, $L^f_{t-1}$, etc. for example, the filter $$L^f_t=AL^f_{t-1}+B\ (L_t+L_{t-1}) \tag{6}$$

where

A=a constant between 0.6 and 0.9

B=a constant between 0.1 and 0.4 may be used.

It will be apparent that the load setpoint $P_2$ (see FIG. 3) can never be reached thus, the load passes into the region of pad collapse 56, the slope becomes negative, preferably the control action reverses, and the plates open enough to cause the load to move to the other side of the peak 54, be again forced closed and operation would oscillate over the peak 54. This is avoided with the present invention by resetting the setpoint P to a value preferably equal $L_{max}$ as described above so that the equipment become stable and operates at the available maximum load.

It will also be apparent that since the setpoint $P_2$ cannot be reached and a new setpoint P is provided and since the properties of the pulp are dependent on the amount of energy applied and operating at the lower setpoint may not apply the required energy, it is necessary to alert the operator as indicated at 84 that the amount of energy that was deemed necessary cannot be applied in this refiner.

Based on this warning, the operator revises the control strategy, for example, by applying more energy in another refiner or changing the production rate, consistency, etc., or if automatic controls are available the warning systems may also be used to trigger the operation of the automatic controls to readjust the operation of the system to obtain required degree of refining.

Figure 5:
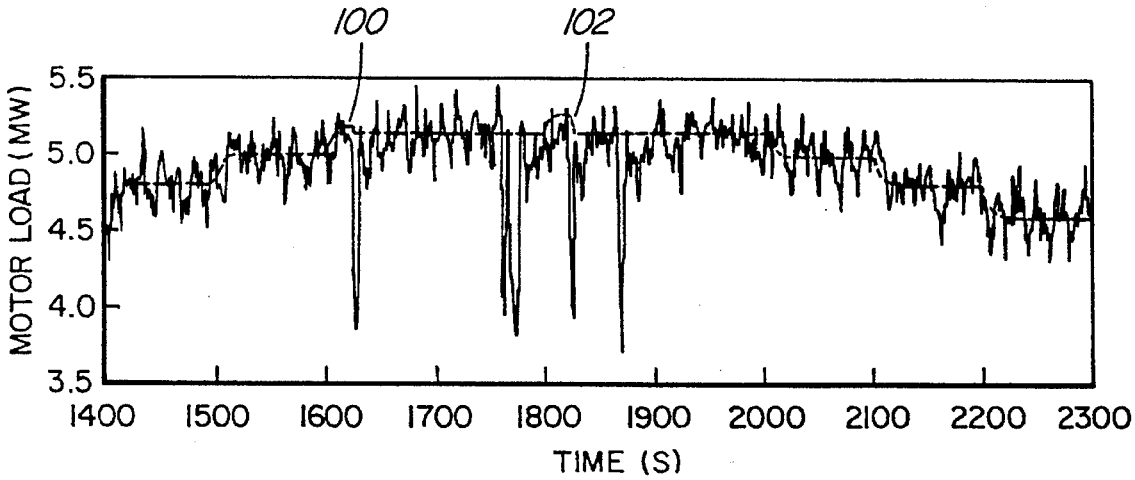
FIG. 5 is an actual plot of motor load versus time showing two setpoint adjustments done automatically using the present invention.

FIG. 5 shows a typical plot of the motor load (solid lines), and the setpoint shown in dash lines illustrating the operation of the present invention, particularly as shown at 100A and 100B wherein when the setpoint was adjusted to a position too high, the equipment automatically returned it to a more stable operating level as indicated at 102A and 102B respectively.

Figure 6:
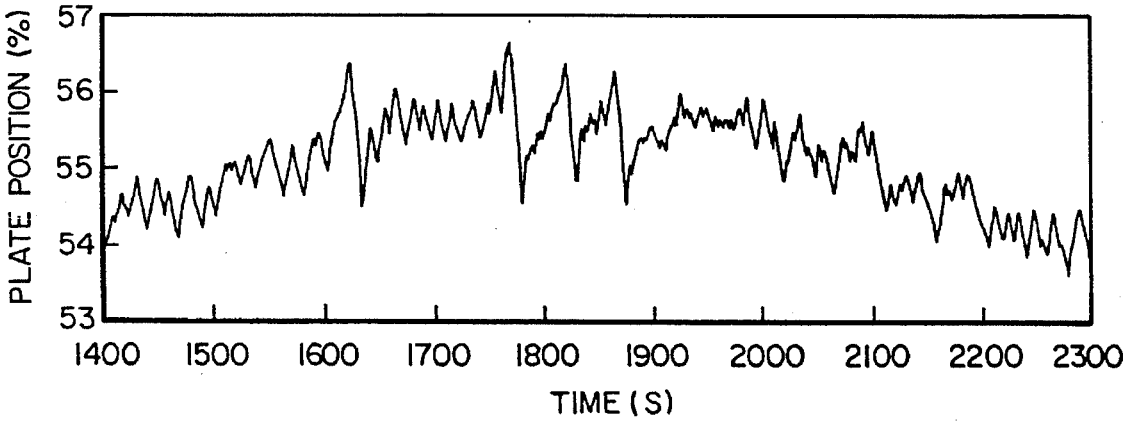
FIG. 6 is a curve of refiner plate position versus time over the same period of time as FIG. 5.

Comparisons of FIGS. 5 and 6 show the change in motor load and the corresponding change in plate position.

Having described the invention, modifications will be evident to those skilled in the art without departing from the spirit of the invention as defined in the appended claims.

We claim:

1. A method for adjusting a selected motor load setpoint of a pulp refiner control for a pulp refiner having a pair of plates defining a plate gap therebetween comprising monitoring said motor load, monitoring the width of said plate gap, estimating the slope $\hat{m}$ of a curve of motor load versus plate gap, determining when said slope of said curve changes sign indicating that the motor load has traversed a peak into an unstable operating zone for the refiner, continuously determining totals ($T_y$) of discrete values ($T_t$) obtained over selected periods of historical time (y), each of said discrete values ($T_t$) being a value produced as a result of said motor load being in said unstable operating zone, determining said values $T_y$ based on $$T_y=\sum_{i=0}^{y-1} T_{t-i} \tag{1}$$

where $T_t$ is based on one of a) the sign of $\hat{m}_t$ where $\hat{m}_t$ is negative, or b) the value of $\hat{m}_t$ where $\hat{m}_t$ is negative, or $$\text{c) } T_t=\frac{\hat{m}_t}{\sigma_t} \tag{2}$$

where $\hat{m}_t$ is negative $\sigma_t$=standard deviation of $\hat{m}_t$ y=a selected number, sensing said motor load over each said period of historical time (y) and the maximum motor load $L_{max}$ over each said period of historical time (y) is determined, comparing said total ($T_y$) with a preselected threshold value (H), and changing said selected motor load setpoint to a new lower motor load setpoint when $T_y$ crosses said selected threshold value H and operating said control to achieve said new lower motor load setpoint.

2. A method as defined in claim 1 wherein said changing comprises setting said new lower setpoint in the range defined by said maximum motor load $L_{(max)}$ sensed over said period of historical time (y) when said total $T_y$ crossed said threshold value H and 0.9 of said $L_{(max)}$ sensed over said period of historical time (y) when said total $T_y$ crossed said threshold value H.

3. A method as defined in claim 1 wherein said values $T_t$ are determined based on the formula $$T_t = \frac{\hat{m}_t}{\sigma_t} \quad (2)$$

where $\hat{m}_t$=negative $\sigma_t$=standard deviation of $\hat{m}_t$.

4. A method as defined in claim 3 wherein said values $T_t$ are determined based on the formula $$T_t = \frac{\hat{m}_t}{\sigma_t} \quad (2)$$

where $\hat{m}_t$=negative $\sigma_t$=standard deviation of $\hat{m}_t$.

* * * * *